United States Patent [19]

Takiguchi

[11] 4,079,229

[45] Mar. 14, 1978

[54] CONTACTING AND HEATING FIXING APPARATUS

[75] Inventor: Koichi Takiguchi, Ebina, Japan

[73] Assignee: Rank Xerox Ltd., London, England

[21] Appl. No.: 770,476

[22] Filed: Feb. 22, 1977

[51] Int. Cl.[2] ..... H05B 1/00

[52] U.S. Cl. ..... 219/216; 219/388; 432/60

[58] Field of Search ..... 219/216, 388, 469–471; 355/3 FU; 432/75, 60, 228; 118/60

[56] References Cited

U.S. PATENT DOCUMENTS

| | | | |
|---|---|---|---|
| 3,880,577 | 4/1975 | Tomono et al. | 219/469 X |
| 3,924,564 | 12/1975 | Ari Bar-on | 219/216 X |
| 3,941,085 | 3/1976 | Hattler et al. | 432/75 X |
| 4,011,353 | 3/1977 | Okamoto et al. | 432/60 X |

*Primary Examiner*—C. L. Albritton

[57] ABSTRACT

A contacting and heating fixing apparatus comprising a first roll of which the surface has a coating of a heat-resistant material with which a toner image of a material to be fixed comes into contact, a second roll for pressing, heating and fixing the material to be fixed in cooperation with said first roll, and a supply mechanism for supplying an offset inhibitor liquid to said heat-resistant parting material on the surface of said first roll, characterized in that supplying of the offset inhibitor liquid from said supply mechanism is made only at warm-up time of a copier.

6 Claims, 3 Drawing Figures

CONTACTING AND HEATING FIXING APPARATUS

BACKGROUND OF THE INVENTION

The present invention relates to a contacting and heating fixing apparatus, and more specifically, to a fixing apparatus in which an image formed of thermoplastic powder (hereinafter referred to as the toner) may permanently be adhered to a support body by heat and pressure.

Conventional fixing apparatus heretofore known has been designed so that a desired pressure is applied between two heated rolls to allow a recording medium having an unfixed toner image therebetween, whereby fixing is effected. This apparatus affords advantages over other types of fixing apparatus in that it requires less electric power and has less possibility of danger due to a fire break-out resulting from jamming of paper in a fixing station. In this fixing apparatus, the heating roll (hereinafter referred to as the first roll) has its surface coated with a heat-resistant parting material such as tetrafluoroethylene (Trade Name: Teflon) whereas the pressure roll (hereinafter referred to as the second roll) comprises silicone rubber or the like coated with fluoroethylene-propylene.

According to the fixing apparatus with the first roll noted above used, in order to prevent a viscous material such as toners from being adhered to the surface of the first roll (hereinafter referred to as the offset phenomenon), a method has been proposed in which offset phenomenon inhibitor liquid such as silicone oil is continuously coated on the first roll.

In the case of using tetrafluoroethylene as a heat-resistant parting coating for the first roll, the thickness thereof is usually from10 $\mu$ to 200 $\mu$ and the surface hardness thereof is relatively high because the parting coating is on a metal core. While the tetrafluoroethylene is preferable in terms of strength of the surface coating, it has suffered from drawbacks such that the image is smashed and toner particles in fog portions are also smashed, resulting in the poor copy quality, since such hard roll is brought into contact with the image to be fixed at the time of fixing while being applied with pressure. In order to overcome the drawbacks noted above, there has recently been developed technologies in which silicone rubber having a flexibility is used as a coating on the first roll. However, even if RTV (room temperature vulcanized type) silicone rubber, which has generally been admitted to have a good parting property, should be used, the service life thereof with respect to the parting property would be short unless the offset inhibitor liquid is supplied. Further, when the silicone oil is supplied as the offset inhibitor liquid, the parting property may be increased, but the rubber itself is swelled by the presence of oil to decrease strength and as a consequence, the surface of adhesion between the silicone rubber and the metal core may be destroyed. In this case also, it is difficult to maintain a long service life. In order to solve these problems noted above, there have been proposed, for example, a method for pre-swelling silicone rubber with silicone oil, and particularly, RTV silicone rubber or the like containing a great quantity of silicone contents whose low molecular weight is analogous to silicone oil. In any of these proposals, the parting property comes to its life at the time when oil contents initially held have been run out to thereby extend the life. But it was not a satisfactory means of settling the problems.

In FIG. 1 there is shown a conventional contacting and heating fixing apparatus which comprises a first roll *a* having a heat-resistant parting outer layer *d* externally coated on a metal core *c* encasing therein a heating element *b*, and a second roll *e* having a layer *h* of fluoroethylene propylene externally coated on a silicone rubber layer *g* round a core *f*. The first roll *a* and the second roll *e* are cooperated with each other by a mechanism not shown to apply pressure to a nip portion thereby through which a support body *j* of toner *i* travels. A supply member *k* supplies an offset phenomenon inhibitor liquid *m* to the first roll *a* through an intermediate supply member *l* and also serves as a cleaning member for cleaning the first roll *a*. The offset phenomenon inhibitor liquid *m* within a container *o* is supplied by a supply roll *n* for supplying the offset phenomenon inhibitor liquid to the intermediate supply member *l*. The reference character *p* designates a weight. A cleaning member *q* and a support member *r* thereof are placed in contact with the second roll *e*.

In the conventional contacting, heating and fixing apparatus, wherein the heat-resistant parting outer layer *d* of the first roll comprises silicone rubber and the offset inhibitor liquid *m* silicone oil, when the oil is supplied, the silicone rubber is swelled with silicone oil to decrease the strength, and particularly, the surface of adhesion between the silicone rubber and the first roll core easily comes off.

BRIEF SUMMARY OF THE INVENTION

It has been found by the present inventor in the course of his study relating to fixing that supply of offset inhibitor liquid to the first roll may be made, for example, once per 1000 copies or once a day without being made always to thereby maintain the offset inhibiting performance of the first roll for a sufficiently long period of time. It has also been found that prior art problems such as swelling caused by the offset inhibitor liquid of the first roll, lowering in strength and skiving of the adhesive layer may materially be relieved by employment of such procedure noted above as compared to the conventional apparatus which always requires a continuous supply of offset inhibitor liquid.

BRIEF DESCRIPTION OF THE DRAWINGS

Other objects and advantages of the present invention will become apparent when read in conjunction with the accompanying drawings wherein.

DETAILED DESCRIPTION OF THE PREFERRED EMBODIMENT

The present invention has been realized in view of the aforementioned circumstances and it is an object of the invention to provide a contacting, heating and fixing apparatus wherein a supply of offset inhibitor liquid by means of an offset inhibitor liquid supplying device is made only at warm-up time of a copier to extend the service life of the apparatus despite supplying silicone oil as the offset inhibitor liquid.

Figure 1:
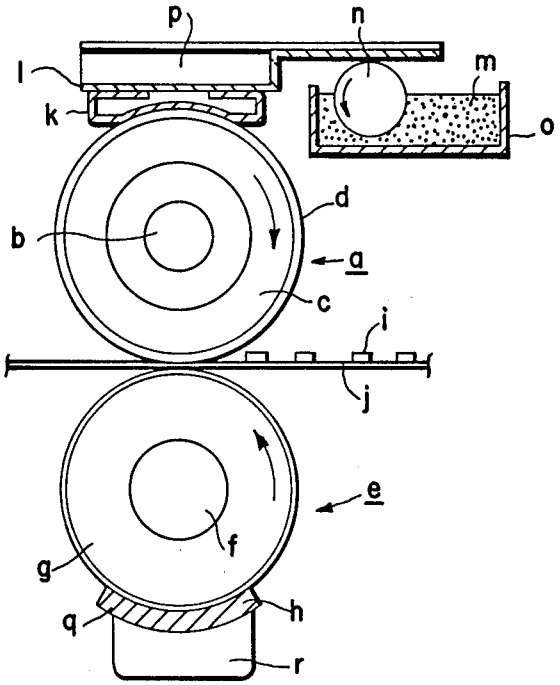
FIG. 1 is an explanatory view showing a construction of a conventional contacting, heating and fixing apparatus.
Figure 2:
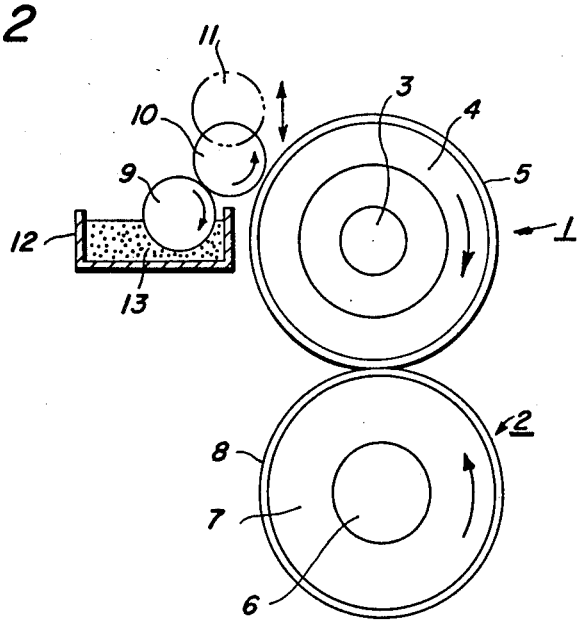
FIG. 2 is an explanatory view showing a construction of one embodiment according to the invention.

The present invention will now be described with reference to FIGS. 2 and 3. A first roll 1 has a heat-resistant parting outer layer 5 externally coated on a metal core 4 encasing therein a heating element 3, and a second roll 2 has a layer 8 of phloroethylenepropylene externally arranged on a silicone rubber layer 7 round a core 6.

The first roll 1 and the second roll 2 cooperated with each other through means of a mechanism not shown to apply pressure to a nip portion. In the FIG. 2 there is shown a container 12 filled with offset inhibitor liquid 13. Supply rolls 9 and 10 for supplying offset inhibitor liquids are rotated by means of a mechanism not shown to supply the offset inhibitor liquid 13 to the first roll 1. The roll 10 is positioned as indicated by the dash-dotted contour lines when the offset inhibitor liquid 13 is not supplied, the roll 10 being moved to the solid line position when liquid 13 is being supplied. The present inventor has conducted various experiments on supply timing of the offset inhibitor liquid 13 to the first roll 1, and as a result, he found that in practice, favorable results may be obtained by supplying the offset inhibitor liquid only at heat-up time of a copier.

That is, the warm-up time from commencement of energization to the fixing device in the copier to the temperature at which the fixing device may carry out fixing is usually about 1 minute to 10 minutes. Only during that time, the offset inhibitor liquid supply rolls 9 and 10 shown in FIG. 2 can be operated. After the fixing device has reached the temperature at which it can carry out fixing, the supply roll 10 can be held in the position as indicated at 11 by means of a mechanism not shown.

Figure 3:
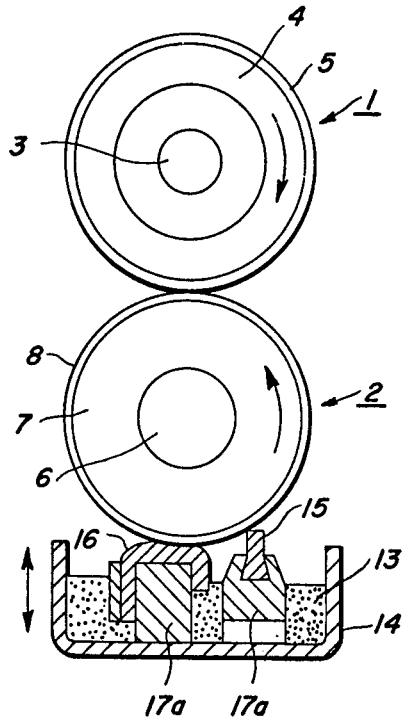
FIG. 3 is an explanatory view showing another embodiment of the invention.

FIG. 3 shows another embodiment according to the present invention, which comprises a container 14 for offset inhibitor liquid 13 and a supply member 16 for supplying the offset inhibitor 13 to the second roll 2, the supply member 16 coming into frictional contact with the second roll 2 to supply the offset inhibitor liquid 13. The apparatus further comprises a control member 15 for controlling the quantity of offset inhibitor liquid 13 supplied to the second roll 2 by means of the supply member 16, and support members 17*a* and 17*b* for supporting the supply member 16 and control member 15, respectively. With the construction as described above, the offset inhibitor liquid 13 is supplied to the first roll 1 through the second roll 2.

The supply or stoppage of the offset inhibitor liquid 13 to the first roll 1 may readily be controlled by moving the container 14 up and down through a mechanism not shown. That is, during the heat-up time, the container 14 is set to a position where the supply member 16 of the offset inhibitor liquid 13 is brought into frictional contact with the second roll 2, as shown in FIG. 3, to thereby rotate the first and second rolls 1 and 2, whereas after the fixing device has reached the temperature at which it can carry out fixing, the container 14 is moved down to a position where the supply member 16 and the control member 15 are not brought into contact with the second roll 2, whereby the offset inhibitor liquid 13 may be supplied only at the heat-up time.

EXAMPLE 1

The first roll 1 was comprised of a roll of external diameter 40 mm whose surface was coated with a heat-resistant parting outer layer 5 comprising KE-12 RTV silicone rubber (of Shin-etsu Chemical make) having thickness 400 $\mu$, whereas the heating element 3 was comprised of a tubular infrared lamp, rated 100V, 600W. The second roll 2 has an iron core 6 with KE-53OU silicone rubber (of Sin-etsu Chemical make) wound therearound, round which is coated with a fluoroethylene propylene heat shrinkable tube 8.

The supply rolls 9 and 10 were made of aluminum, and KF96 silicone oil (of Shin-etsu Chemical make) was used as the offset inhibitor liquid.

It was designed so that supply of silicone oil by the supply rolls 9 and 10 was made only at warm-up time by means of a mechanism not shown.

Use of Teflon felt was made for the conventional supply member *k*, wool felt for the intermediate supply member *l*, and also wool felt for the cleaning member *g*. Further, use of KF96 silicone oil was made for the offset phenomenon inhibitor liquid.

The surface temperature of the first roll was controlled to be at 170° C to fix a toner image formed on a L-1 paper (of Fuji Xerox make) using 4000 toners (of Fuji Xerox make), with the result that, according to prior art apparatus, the heat-resistant parting outer layer KE-12RTV of the first roll came off the core after about 3000 copies have been produced.

Further, in prior art apparatus, where no silicone oil is supplied, the parting property was decreased after about 11,000 copies had been produced, resulting in a frequent occurrence of twine round the first roll thus leading to short life. That is, in prior art systems, where oil is supplied, life was reached with 3000 copies, whereas, where no oil is supplied, life was reached with 11,000 copies. According to the construction of the present invention as shown in FIG. 2, where oil is supplied only at warm-up time (four minutes in this test) of a copier, the KE-12 RTV silicone rubber came off the core 4 after about 75,000 copies have been produced, thus leading to long life. This means an improvement of about 6.9 times the life.

EXAMPLE 2

In the construction as shown in FIG. 3, the first roll 1 was comprised of a roll of external diameter 40mm whose surface was coated with a heat-resistant parting outer layer 5 comprising KE-530 RTV silicone rubber (of Shin-etsu Chemical make) having thickness 400$\mu$, and the heating element 3 as well as the second roll 2 was similarly formed as those described in EXAMPLE 1.

Use of Teflon felt was made for the offset inhibitor liquid supply member 16, and Viton blade (of Fujikura Rubber make) for the supply-quantity control member. Use of KF-96 silicone oil was made for the offset inhibitor liquid 13 similarly to EXAMPLE 1. In the case where the silicone oil is continuously supplied, a good parting property of toner was obtained so that the heat-resistant parting outer layer 5 of the first roll came off the core 4 after 24,000 copies had been produced, thus leading to short life, whereas in the case where the oil is made to be supplied only at warm-up time by moving the container 14 up and down through a mechanism not shown, a good parting property of toner was obtained so that the heat-resistant parting outer layer 5 did not come off the core 4 until 97,500 copies were produced. This means an improvement of about 4 times the life.

While the contacting, heating and fixing apparatus of the type in which only the first roll is provided with a heating element has been described in the foregoing embodiments of the present invention, it will of course be understood that apparatus of the type in which both rolls are each provided with a heating element or the externally heating type may effectively be employed. Further, while method of supplying offset inhibitor liquid at heat-up time by the use of roll or method of supplying the same from the side of the second roll has been illustrated in the foregoing embodiments, it should be appreciated that any system as long as it provides an arrangement wherein inhibitor liquid is supplied at warm-up time but stopped to be supplied otherwise is within the scope of the present invention. In addition, a modified method, wherein a copier is energized the first thing in the morning by utilization of timer or the like, after which inhibitor liquid is supplied only in a given time, is naturally within the scope of the present invention.

From the foregoing detailed description, it will be appreciated in the present invention that a supply of offset inhibitor liquid by means of an offset inhibitor liquid supplying device may be made only during warm-up time of a copier to substantially extend a service life of apparatus despite supplying silicone oil as the offset inhibitor liquid.

What is claimed is:

1. Fuser apparatus for fixing toner images to copy paper, said apparatus comprising:

a first roll member having an outer layer of silicone rubber;

a second roll member cooperating with said first roll member to form a nip through which copy paper is passed with said toner images contacting said outer layer of silicone rubber;

means for elevating the temperature of said first roll during a warmup period; and means for applying a liquid separating material to said first roll member only during said warmup period.

2. Apparatus according to claim 1 wherein said temperature elevating means comprises a heating element disposed entirely on said first roll member.

3. Apparatus according to claim 1 wherein said means for applying said liquid separating material comprises at least one roll member adapted to be moved into and out of engagement with said first roll member.

4. Apparatus according to claim 3, wherein said means for applying said liquid separating means comprises a pair of rolls one of which contacts a supply of said liquid separating means and the other of which contacts said first roll member such that the separating means can be conveyed from said supply to said first roll member.

5. Apparatus according to claim 4, wherein said liquid separating means comprises silicone oil.

6. Apparatus according to claim 4 wherein said rolls are fabricated from aluminum.

* * * * *